US009147542B2

(12) United States Patent
Parashar

(10) Patent No.: US 9,147,542 B2
(45) Date of Patent: Sep. 29, 2015

(54) VACUUM INTERRUPTER

(75) Inventor: Rama Shankar Parashar, Stafford (GB)

(73) Assignee: ALSTOM TECHNOLOGY LTD. (CH)

( * ) Notice: Subject to any disclaimer, the term of this patent is extended or adjusted under 35 U.S.C. 154(b) by 252 days.

(21) Appl. No.: 13/637,068

(22) PCT Filed: Apr. 2, 2010

(86) PCT No.: PCT/EP2010/054464

§ 371 (c)(1), (2), (4) Date: Sep. 25, 2012

(87) PCT Pub. No.: WO2011/120590

PCT Pub. Date: Oct. 6, 2011

(65) Prior Publication Data

US 2013/0015161 A1 Jan. 17, 2013

(51) Int. Cl.
*H01H 33/666* (2006.01)
*H01H 33/662* (2006.01)

(52) U.S. Cl.
CPC ... *H01H 33/66238* (2013.01); *H01H 33/66207* (2013.01); *H01H 33/66261* (2013.01); *H01H 2033/66223* (2013.01)

(58) Field of Classification Search
CPC ..... H01H 33/666; H01H 9/0038; H01H 33/66207; H01H 2033/6665; H01H 33/66
See application file for complete search history.

(56) References Cited

U.S. PATENT DOCUMENTS 3,166,658 A * 1/1965 Jennings ..... 218/138
3,814,882 A * 6/1974 Harrold ..... 218/121
4,365,127 A * 12/1982 Sakuma et al. ..... 218/136
4,401,868 A * 8/1983 Wootton et al. ..... 218/127
5,254,817 A * 10/1993 Inagaki ..... 218/132
6,114,647 A * 9/2000 Morita et al. ..... 218/135
8,497,445 B2 * 7/2013 Yoshida et al. ..... 218/134
2007/0090095 A1 * 4/2007 Yoshida et al. ..... 218/118

FOREIGN PATENT DOCUMENTS

GB 1259501 1/1972

* cited by examiner

*Primary Examiner* — Truc Nguyen

(74) *Attorney, Agent, or Firm* — Baker Hostetler LLP

(57) ABSTRACT

A vacuum interrupter comprises a tubular bellows (30) including a first hollow bore (32); at least one sub-assembly (34), each sub-assembly (34) including an end cap (42), the or each end cap (42) including at least one second hollow bore and having a composition including glass or including glass-ceramic; at least one primary annular metallic element (36) being operably connected between the or each end cap (42) and one of respective ends of the tubular bellows (30); a pair of electrically conductive contact elements (38); and a pair of electrically conductive rods (40), each rod (40) being operably connected to a respective contact element (38) at a first end and being connected in use to an electrical network at a second end, a portion of at least one rod (40) being retained inside the or each second hollow bore of a respective end cap (42), wherein the or each end cap (42) and each rod (40) are operably connected to one of the respective ends of the tubular bellows (30) to define a vacuum-tight enclosure; the contact elements (38) are located inside the enclosure and arranged to define opposed contact surfaces; and the tubular bellows (30) is controllable to expand or contract to move one rod (40) relative to the other rod (40) to open or close a gap between the opposed contact surfaces.

61 Claims, 8 Drawing Sheets

VACUUM INTERRUPTER

This invention relates to a vacuum interrupter.

Vacuum interrupters are typically used to act as a load break switch or a circuit breaker in medium and high voltage applications. The operation of the vacuum interrupter relies on the mechanical separation of electrically conductive contacts to open the associated electrical circuit. The operation of the vacuum interrupter at higher voltages results in the development of high electrical stress which may lead to electrical breakdown not only between the contacts, but also external to the vacuum interrupter.

Electrical breakdown occurs when the dielectric strength of a medium is exceeded. This may lead to the initiation of internal and/or external arc discharges which can cause degradation of the vacuum interrupter and affect the safety of those working in the immediate vicinity of the vacuum interrupter. The separation of the contacts is typically carried out in a high vacuum environment to extinguish the arc initiated across its contacts. It is, however, still necessary to provide external insulation to the vacuum interrupter which not only extends the lifetime of the vacuum interrupter by avoiding damage due to electrical breakdown but also ensures a safe working environment in the immediate vicinity of the vacuum interrupter.

A known solution of providing external electrical insulation for a vacuum interrupter is the use of metallised and nickel-plated alumina ceramic housings, as shown in FIG. 1.

FIG. 1 shows a typical layout of components in a vacuum interrupter 10 up to an operating voltage rating of 72 kV. The vacuum interrupter 10 uses conventional metallised and nickel-plated cylindrical housings 12 with lengths and diameters appropriate to the operating voltage rating of the vacuum interrupter 10. The vacuum interrupter 10 includes first and second end flanges 14*a*,14*b*, each end flange 14*a*,14*b* being brazed to a first end of one of the respective cylindrical housings 12 to form a hermetic joint. The two cylindrical housings 12 are joined together at their second ends via an annular structure 16 including a shield 18 which overlaps inner walls of the cylindrical housings 12. The shield 18 acts to protect the inner walls of the cylindrical housings 12 from metal deposition arising from arc discharge.

Both end flanges 14*a* and 14*b* are fixed relative to the corresponding cylindrical housing 12. The second end flange 14*b* includes a hollow bore to accommodate a metallic bellows 20. The metallic bellows 20 also includes a hollow bore for retention of a first oxygen-free high-conductivity (OFHC) copper conductor 22*b*. The first end flange 14*a* includes a hollow bore to accommodate a second OFHC copper conductor 22*a* within its hollow bore.

Each of the copper conductors 22*a*,22*b* are connected to electrical networks at a first end and connected to an arcing contact 24*a*,24*b* at a second end. The copper conductors 22*a*,22*b* are arranged such that the arcing contacts 24*a*,24*b* are located inside the cylindrical housings 12 and opposite each other to form opposed contacts 24*a*,24*b*. A switching process is carried out by operating the metallic bellows 20 to deform so as to move the conductor 22*b* closer to or further from the conductor 22*a* and thereby closing or opening the gap 26 between the opposed contacts 24*a*,24*b* at the end of the copper conductors 22*a*,22*b*.

As the operating voltage rating of vacuum circuit breakers is increased, the length of the vacuum interrupter generally becomes longer. This is achieved by designing ceramic envelopes with longer lengths or by using multiple envelopes to extend the length of the vacuum interrupter. While the required internal dielectric rating of the vacuum interrupter is easily achieved by current and voltage conditioning, the external dielectric rating of the vacuum interrupter in air is dependent upon the length of the alumina ceramic envelope. These alumina ceramic envelopes represent a significant proportion of the material cost of the vacuum interrupters. This, therefore, leads to an increased cost when lengthening the alumina ceramic housing to accommodate the increased voltage rating of the vacuum interrupter.

In addition, the use of alumina ceramic housings raises environmental and cost concerns because of their energy-intensive manufacture and their disposal at landfill sites at the end of their respective lifetimes.

Another known solution of providing electrical insulation for a vacuum interrupter is by using polymeric material to overmould the interrupter housing or by placing corrugation or polymeric sheds on the external surfaces of the interrupter. The polymeric overmoulding and sheds provide additional electrical insulation for the vacuum interrupter while the corrugations increase creepage distance to improve dielectric performance and voltage rating of the vacuum interrupter. The use of polymeric components, however, not only increases the cost of manufacture of the vacuum interrupter, but also exposes the interrupter to a risk of in-service failure caused by deterioration of the interfacial layer between the polymeric components and the interrupter. In addition, the inclusion of external corrugations or sheds in the design of alumina ceramic housings can become expensive because of machining costs.

A third known solution of providing electrical insulation for a vacuum interrupter is by locating the vacuum interrupter in an external housing and filling the space between the vacuum interrupter and the external housing with either solid insulation material or sulphur hexafluoride, $SF_6$, trifluro-iodo-methane, $CF_3I$ or other gas mixtures which offer excellent dielectric properties and enhances the external dielectric rating of the vacuum interrupter. The provision of an external housing filled with solid insulation material, however, adds size and weight to the vacuum interrupter. In addition, the use of $SF_6$, which is a greenhouse gas, means that it is necessary to carry out regular inspection and maintenance to prevent leakage of $SF_6$ into the atmosphere and therefore adds to the complexity of the vacuum interrupter. Different alternatives like $CF_3I$ and other gas mixtures also require regular inspection and maintenance.

According to an aspect of the invention, there is provided a vacuum interrupter comprising a tubular bellows including a first hollow bore; at least one sub-assembly, the or each sub-assembly including an end cap, the or each end cap including at least one second hollow bore and having a composition including glass or including glass-ceramic; at least one primary annular metallic element being operably connected between the or each end cap and one of respective ends of the tubular bellows; a pair of electrically conductive contact elements; and a pair of electrically conductive rods, each rod being operably connected to a respective contact element at a first end and being connected in use to an electrical network at a second end, a portion of at least one rod being retained inside the or each second hollow bore of a respective end cap, wherein the or each end cap and each rod are operably connected to one of the respective ends of the tubular bellows to define a vacuum-tight enclosure; the contact elements are located inside the enclosure and arranged to define opposed contact surfaces; and the tubular bellows is controllable to expand or contract to move one rod relative to the other rod to open or close a gap between the opposed contact surfaces.

The provision of at least one primary annular metallic element results in a modular construction of the vacuum interrupter in which one or more primary annular metallic elements are used to interconnect different vacuum interrupter components, such as end caps and tubular bellows, which can have different shapes and sizes. The modular construction simplifies the design process for the vacuum interrupter because each vacuum interrupter component may be designed for fitment of a primary annular metallic element instead of being designed to accommodate different types of connectors for connection to different components. It is, therefore, straightforward to add and remove components to the design of the vacuum interrupter when accounting for different operating environments which require different voltage ratings and/or have adverse weather conditions.

The design based on the use of primary annular metallic elements allows for the self-alignment of components during construction of the vacuum interrupter and thereby simplifies the task of assembling heavy vacuum interrupter components. Each vacuum interrupter component may, for example, include features such as grooves for fitment of the primary annular metallic element. These grooves and the corresponding primary annular metallic element can be used to properly position a vacuum interrupter component on top of another. This leads to an increase in accuracy and efficiency of the manufacture and assembly of the vacuum interrupter.

Vacuum interrupter end caps based on glass and/or glass-ceramic compositions provide excellent electrical insulation and are highly resistant to corrosion which removes the need for external housing when the vacuum interrupter is used outdoors.

Preferably the or each end cap includes a groove for retention of a primary annular metallic element.

The retention of a primary annular metallic element in a groove of an end cap improves the mechanical strength of the joint between the primary annular metallic element and the respective end cap, and thereby reduces the likelihood of leakage due to failure of the joint.

In embodiments of the invention an outer wall of the or each end cap may be tapered to define a truncated cone, the base of the or each truncated cone being connected to a primary annular metallic element.

In other embodiments the or each end cap may be substantially cylindrical and includes an outwardly projecting first circumferential portion. In such an embodiment, the first circumferential portion may be in the form of a flange.

In further embodiments the or each end cap may include an inwardly curved surface to define an inner wall of the vacuum-tight enclosure. In such embodiments, a lip of the or each second hollow bore may project from the inner wall to define a first tubular projection within the vacuum-tight enclosure.

The shape of glass-based or glass-ceramic-based end caps can be easily and cheaply varied to provide the necessary electrical insulation for the vacuum interrupter. This reduces the complexity of the design and manufacturing process because it is only necessary to account for the shape of the end cap when trying to achieve a specific level of electrical insulation. In addition, the modular construction of the vacuum interrupter means that it is straightforward to achieve different vacuum interrupter characteristics by interchanging end caps with different shapes and sizes.

The use of end caps of different shapes to provide the necessary electrical insulation leads to a decrease in interrupter size, weight and cost by removing the need for other methods of providing electrical insulation such as external polymeric housing and sheds, surrounding the interrupter with insulation material and/or enclosing the interrupter in a housing filled with sulphur hexafluoride, $SF_6$, trifluro-iodomethane, $CF_3I$ or other gas mixtures, these other methods having disadvantages in terms of hardware size, economy and environmental concerns.

In another embodiment, the or each end cap may include two or more second hollow bores.

The provision of two or more second hollow bores in each end cap allows the use of more than one rod which increases the potential compatibility with rods used in other power applications.

Preferably each rod is made from copper.

Copper rods are suitable for vacuum interruption applications due to the excellent thermal and electrical characteristics of copper.

In embodiments of the invention the or each end cap may be bonded using brazed joints to the portion of the or each rod retained inside its respective second hollow bore.

The provision of a brazed joint between the rod and the end cap results in a vacuum-tight hermetic seal which is necessary to help retain the vacuum inside the enclosure of the vacuum interrupter.

In other embodiments the or each sub-assembly may further include at least one secondary annular metallic element retained between a wall of the respective second hollow bore of the end cap and the respective portion of the rod.

The or each secondary annular metallic element acts as a seal between the respective end cap and rod to retain the vacuum inside the enclosure of the vacuum interrupter. The use of a secondary annular metallic element as a seal component means that the secondary annular metallic element may be adapted to allow the respective end cap and rod to be used not only with different types of rods and end caps respectively, but also as components in other types of applications.

In such embodiments employing the use of a secondary annular metallic element, the or each secondary annular metallic element may include an outwardly projecting second circumferential portion defining a shield between the corresponding end cap and contact element.

In further embodiments each rod may include an outwardly projecting third circumferential portion defining a shield between the corresponding end cap and contact element.

In such embodiments the or each circumferential portion may be in the form of a flange.

During operation of the vacuum interrupter, arcing between the contact elements results in the development of evaporated metal which can result in deposition of metal onto the vacuum interrupter components within the enclosure and thereby reduce the electrical insulation of the vacuum interrupter. The provision of a shield between the contact elements and the respective end caps limits the amount of deposited metal on the end caps during the arcing of the contact elements, and thereby increases the lifetime of the vacuum interrupter.

The vacuum interrupter preferably further includes one or more housing members, the or each housing member being operably connected between the tubular bellows and the respective sub-assembly to define the vacuum-tight enclosure wherein the or each housing member defines first and second housing portions, the first housing portion defining a third hollow bore and being located within the enclosure and the second housing portion being located outside the enclosure.

The provision of one or more housing members permits the extension of the vacuum interrupter length and thereby increases the potential amount of separation between the opposed contact surfaces. This leads to an increase in voltage rating and performance of the vacuum interrupter.

The use of housing members is also compatible with the modular construction of the vacuum interrupter since it is possible to design the housing members to have a standard shape and size and to be stackable on top of each other to extend the vacuum interrupter length. The use of standard housing members leads to a reduction in manufacturing cost.

Preferably the or each housing member may be connected to an end cap, a neighbouring housing member or one of the respective ends of the tubular bellows via at least one primary annular metallic element.

Two primary annular metallic elements may be connected to one another to form a brazed joint to connect the or each housing member to an end cap, a neighbouring housing member or one of the respective ends of the tubular bellows.

Such use of primary annular metallic elements to form a brazed joint results in a vacuum interrupter with self-aligning components. For example, a primary annular metallic element may be machined to closely fit another primary annular element so that their connection leads to the alignment of different housing members, each housing member being connected to the respective primary annular metallic element.

In other embodiments the or each housing member may include at least one groove for retention of each corresponding primary annular metallic element.

The or each housing member may be designed for fitment of primary annular metallic elements for connection to the other vacuum interrupter components.

In embodiments employing the use of housing members, a lip of the or each third hollow bore may project from an end or both ends of the respective first housing portion to define a second tubular projection at the respective end within the vacuum-tight enclosure.

The second tubular projections extending from the ends of the or each first housing portion provide shields to protect the inner surfaces of the enclosures from the effects of vapour deposition due to arcing of the contact elements. Since deposition of metal vapour is limited to the surface of the second tubular projections, the shielded inner surfaces of the enclosure remain clean of vapour deposition and thereby provide the necessary electrical insulation for the vacuum interrupter.

In other embodiments employing the use of housing members, the or each housing member further includes a shed in the form of an outwardly projecting fourth circumferential portion.

The inclusion of a shed in the or each housing member not only improves the electrical insulation level of the vacuum interrupter but also provides protective shields for an outdoors vacuum interrupter in adverse weather conditions.

In further embodiments employing the use of housing members, the or at least one housing member may be formed from a glass or glass-ceramic material.

Vacuum interrupter housing members based on glass and/or ceramic compositions provide excellent electrical insulation and are highly resistant to corrosion which removes the need for external housing when the interrupter is used outdoors.

In such embodiments, where the or each housing member is formed from a glass or glass-ceramic material and the or each housing member includes a shed, the or each shed may be formed from a glass or glass-ceramic material having a lower melting point than the glass or glass-ceramic material used in the corresponding housing member.

The similar thermal properties of glass or glass-ceramic sheds and housing members minimises the problem of deteriorating interfacial layers typically associated with polymeric sheds attached to alumina ceramic housings. In addition, the ease of processing glass and glass-ceramic materials means that these optional sheds may be manufactured as part of the respective housing member or be added onto the respective housing member at a later stage.

In other embodiments, the or at least one housing member may have a metallic composition to define an arc containment chamber and the contact elements are located within the arc containment chamber.

The provision of an arc containment chamber provides protection for the tubular bellows from damage arising from arc instability, maintains the dielectric strength of the vacuum interrupter components by limiting the effects of metal vapour deposition and ensures the parallelism of electrostatic field lines within the vacuum interrupter.

In embodiments of the invention an external shield may be provided around the tubular bellows.

The external shield provides mechanical protection for the tubular bellows. This is particularly advantageous for vacuum interrupters which are used in outdoor environments.

The external shield may also include an outwardly projecting fifth circumferential portion such as a flange. The circumferential portion can be used to mount the vacuum interrupter onto an external platform or be used to limit the travel distance of the tubular bellows so as to provide better control over the operation of the vacuum interrupter.

In other further embodiments each rod may be substantially cylindrical and the vacuum interrupter may be axi-symmetric about the cylindrical axis of each rod.

The provision of an axi-symmetric vacuum interrupter results in an homogeneous distribution of electrical stress about the axis of the cylindrical rods, which simplifies the design process of electrical insulation for the vacuum interrupter. In addition, the homogenous distribution of electrical stress minimise the possibility of the development of regions with high electrical stress.

Preferred embodiments of the invention will now be described, by way of non-limiting examples, with reference to the accompanying drawings in which.

Figure 1:
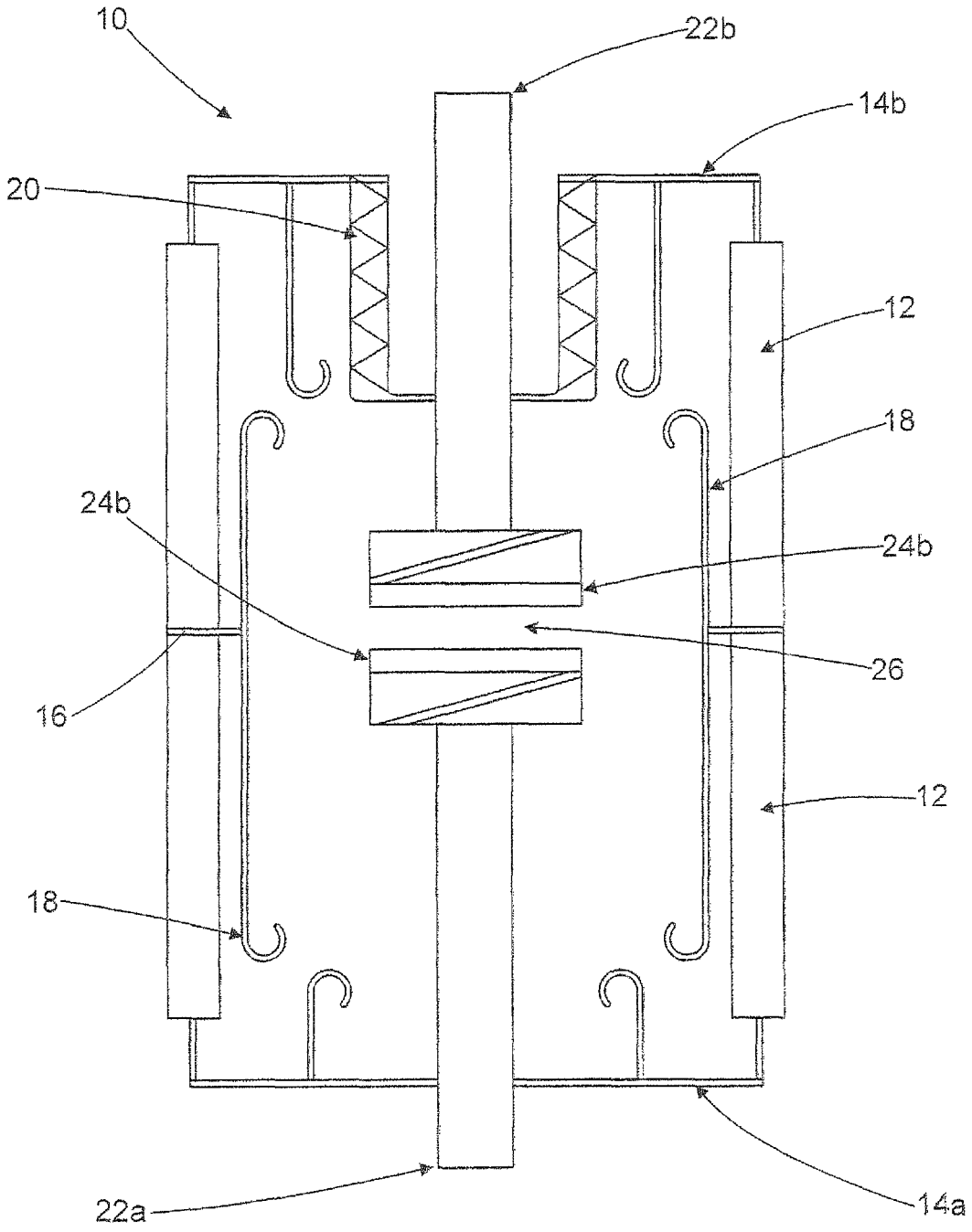
FIG. 1 shows a prior art vacuum interrupter based on metallised and nickel-plated alumina ceramic housings.
Figure 2:
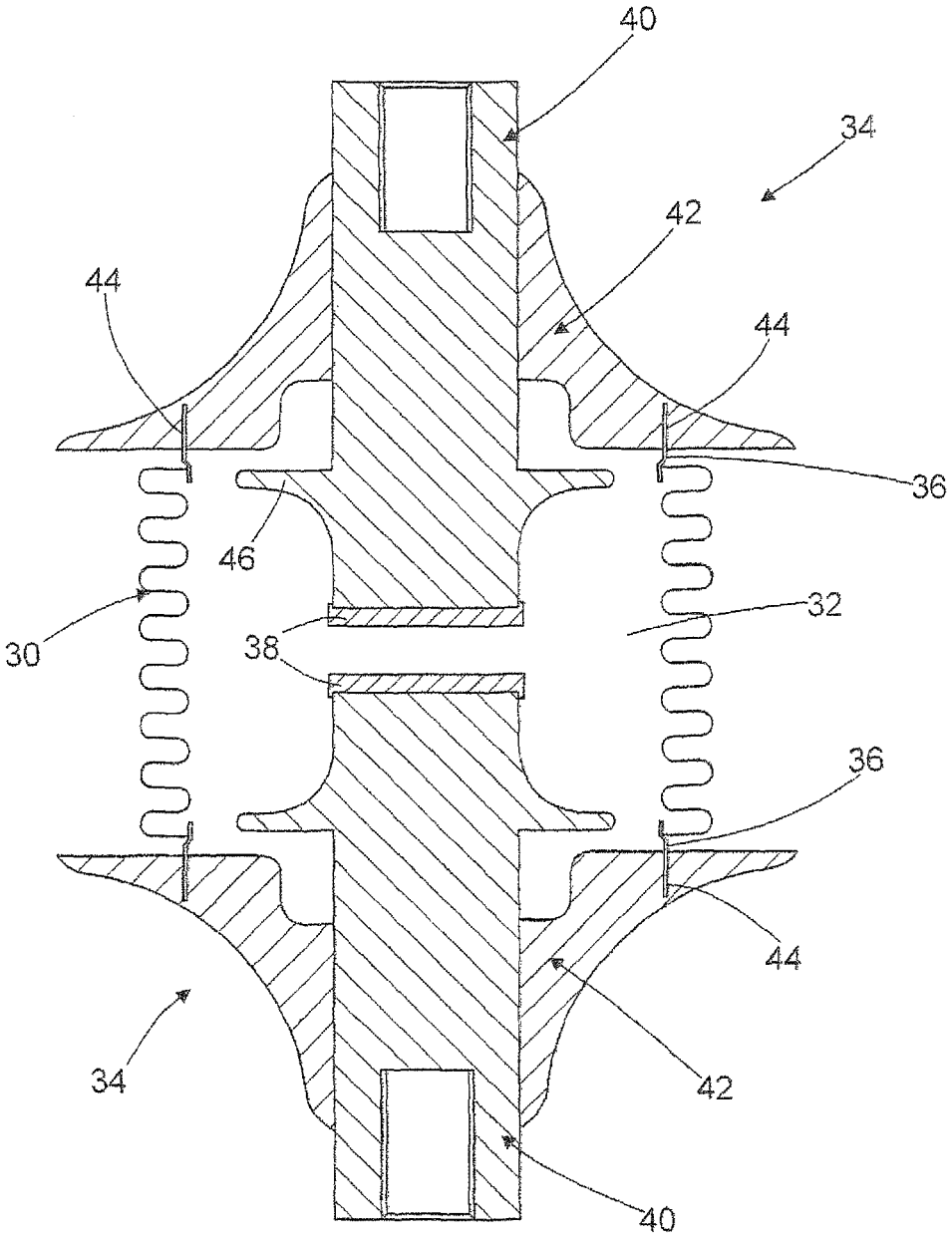
FIG. 2 shows a vacuum interrupter according to a first embodiment of the invention.

A vacuum interrupter according to a first embodiment of the invention is shown in FIG. 2.

The vacuum interrupter comprises a tubular bellows 30; two sub-assemblies 34; two primary annular metallic elements 36; a pair of electrically conductive contact elements 38; and a pair of electrically conductive rods 40.

The tubular bellows 30 includes a first hollow bore 32; and the corrugated walls of the tubular bellows 30 allow the tubular bellows 30 to undergo deformation so as to increase or decrease the length of the tubular bellows 30.

Each sub-assembly 34 includes an end cap 42, each end cap 42 including a second hollow bore. The outer wall of each end cap 42 is tapered such that the respective end cap 42 defines a truncated cone. The base of each truncated cone includes a groove 44 which retains a primary annular metallic element 36, such as a metallic ring, which is brazed to one of respective ends of the tubular bellows 30.

The pair of electrically conductive rods 40 may be made from copper, preferably oxygen-free high-conductivity copper, for its excellent thermal and electrical properties. Each rod 40 is connected to a respective contact element 38 at a first end and connected in use to an electrical network at a second end. A portion of each rod 40 is retained inside the second hollow bore of the respective end cap 42. The rods 40 are aligned so that the contact elements 38 are positioned opposite each other to define opposed contact surfaces.

Each primary annular metallic element 36 interconnects the respective end cap 42 to one of the respective ends of the tubular bellows 30 such that the arrangement of the end caps 42, tubular bellows 30 and the rods 40 defines a vacuum-tight enclosure whereby the contact elements 38 are located inside the enclosure. The vacuum-tight enclosure can be evacuated to provide a vacuum environment. Each end cap 42 is bonded using a glass or glass-ceramic-to-metal joining process to the portion of the rod 40 retained inside its second hollow bore to provide a hermetic seal.

Each rod 40 may include an outwardly projecting third circumferential portion 46 to define a shield between the corresponding end cap 42 and contact element 38. Each third circumferential portion 46 may be manufactured using flow-forming of the respective rod 40 to provide the required shape of the shield. It is envisaged that in embodiments of the invention, each third circumferential portion 46 may be in the form of a flange at the end of the respective rod 40 connected to the contact element 38.

To carry out a switching process, the tubular bellows 30 is controllable to expand or contract to move one rod 40 relative to the other via the supported sub-assemblies 34 such that the gap between the opposed contact surfaces may open or close. The opening and closing of the gap between the opposed contact surfaces allows the vacuum interrupter to open or close the connection between the electrical networks associated with the respective rods 40.

Figure 3:
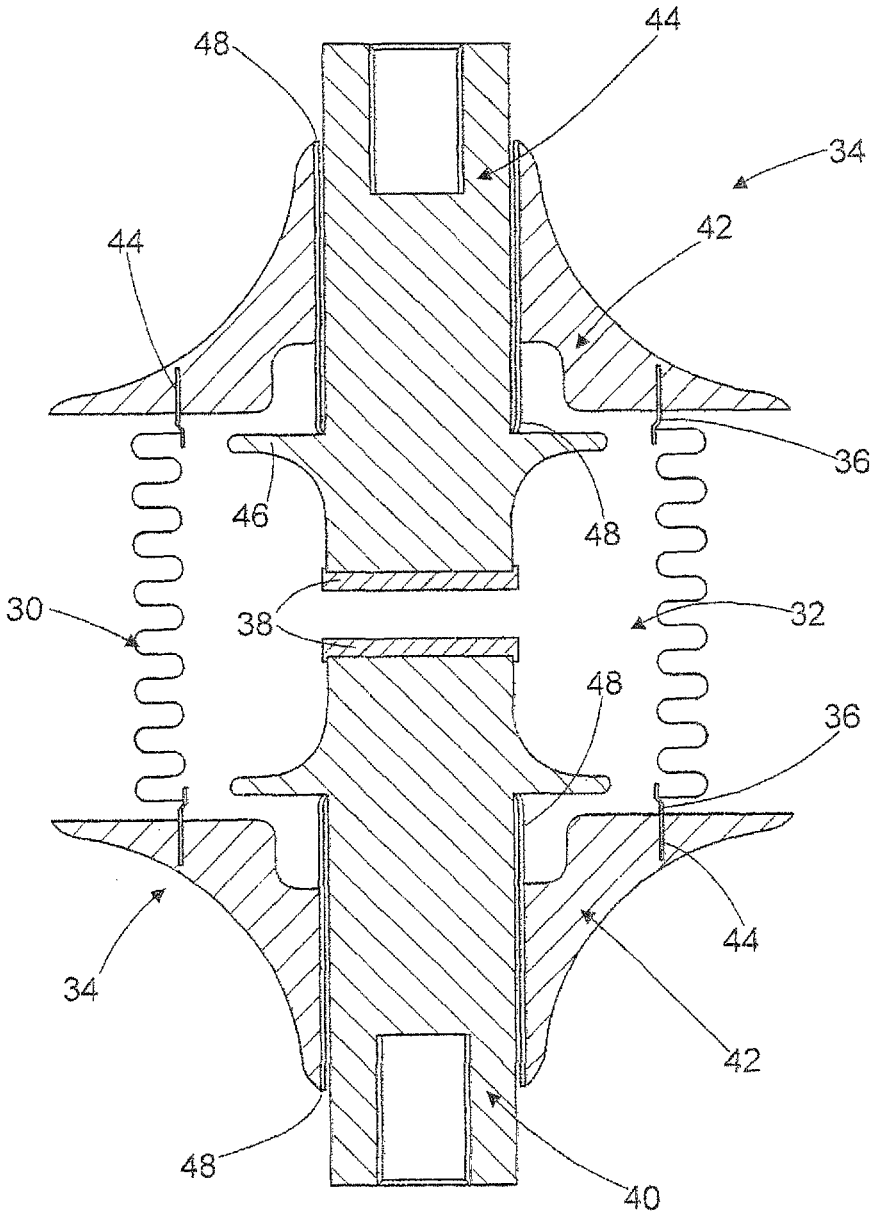
FIG. 3 shows a vacuum interrupter according to a second embodiment of the invention.

A vacuum interrupter according to a second embodiment of the invention is shown in FIG. 3. This vacuum interrupter is similar to the embodiment shown in FIG. 2 except that instead of using glass or glass-ceramic-to-metal joint to interconnect each rod 40 and the respective end cap 42, each sub-assembly 34 further includes a secondary annular metallic element 48 retained between a wall of the respective second hollow bore of the end cap 42 and the respective portion of the rod 40. The metallic element 48 is joined with the interconnect rod 40 using a brazing process.

Each secondary annular metallic element 48 acts as a seal between the respective end cap 42 and rod 40 to retain the vacuum environment inside the enclosure of the vacuum interrupter. The use of a secondary annular metallic element 48 as a seal means that the secondary annular metallic element 48 may be adapted to allow the respective end cap 42 and rod 40 to be used not only with different types of rods 40 and end caps 42 respectively, but also as components in other types of applications.

Figure 4:
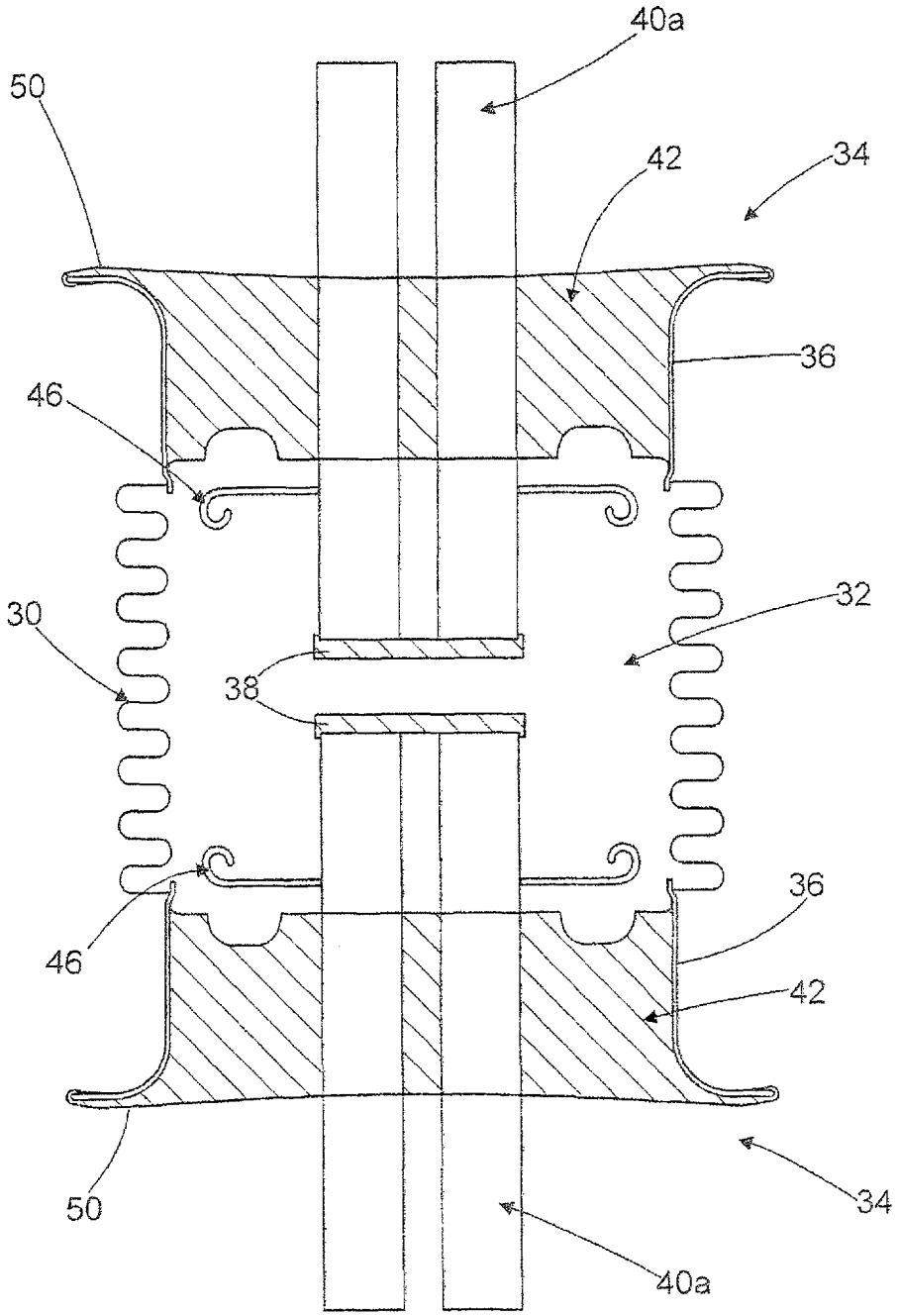
FIG. 4 shows a vacuum interrupter according to a third embodiment of the invention.

In the embodiment shown in FIG. 4, each end cap 42 of the vacuum interrupter is substantially cylindrical and includes an outwardly projecting first circumferential portion 50 in the form of a flange. The flange extends from a first end of the respective end cap 42 while a second end of the respective end cap 42 is connected to one of the respective ends of the tubular bellows 30 via a primary annular metallic element 36 which surrounds the outer wall of the respective end cap 42.

Each end cap 42 also includes a further second hollow bore to accommodate a further rod **40*a* such that each contact element 38 is supported by a pair of rods 40*a*. A second end of each rod 40*a* may be connected in use to an electrical network. Each rod 40 may include an outwardly projecting third circumferential portion 46 attached to the circumference of the rod 40 to define a shield between the corresponding end cap 42 and contact element 38. It is envisaged that in other embodiments of the invention, each end cap 42** may include any number or shape of second hollow bores to accommodate different numbers of rods and/or rods of different shapes and sizes. Each end cap may also be adapted to accommodate standardized rods used in other power applications as a cost-saving measure.

Figure 5:
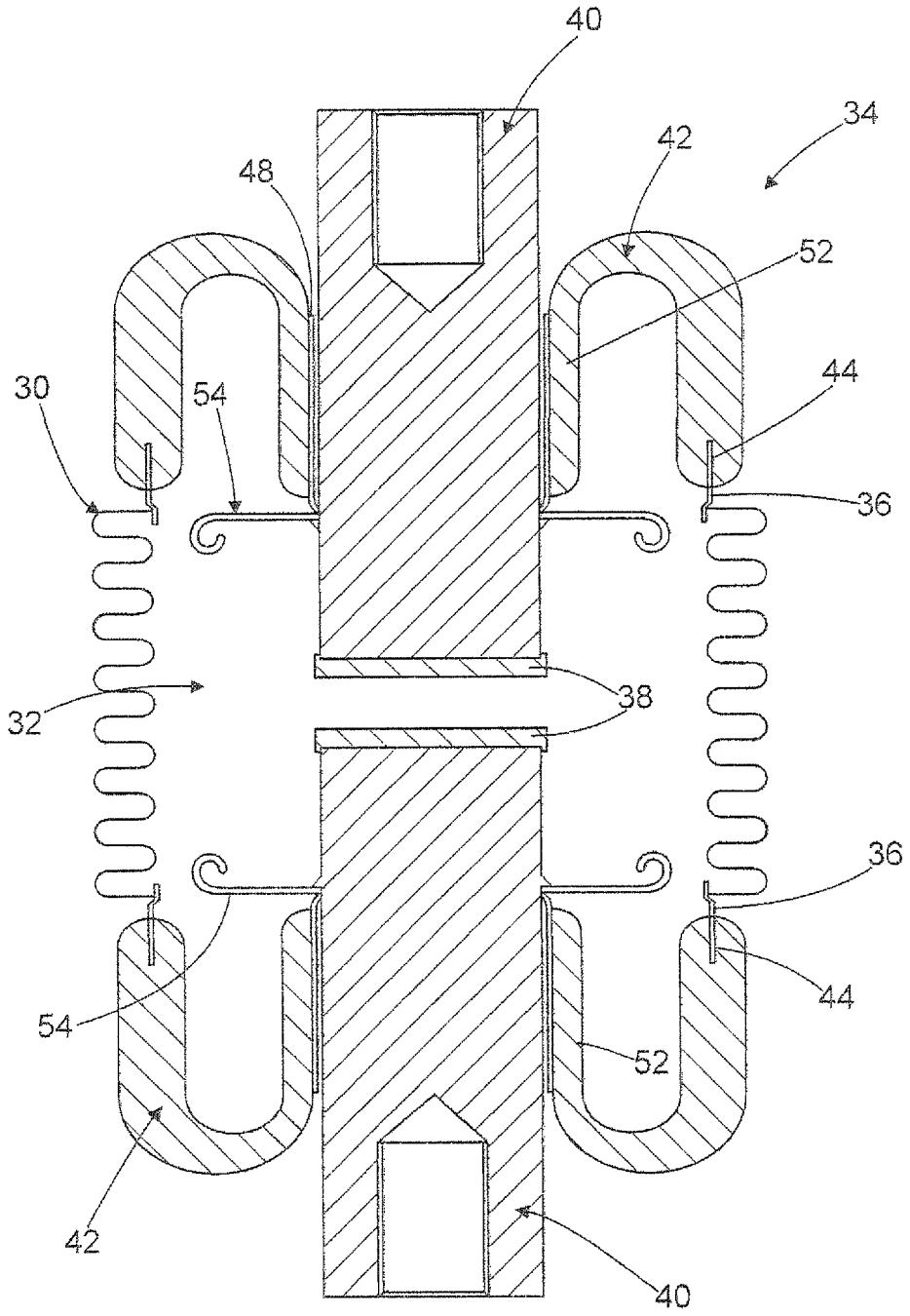
FIG. 5 shows a vacuum interrupter according to a fourth embodiment of the invention.

A vacuum interrupter according to a fourth embodiment of the invention is shown in FIG. 5.

Each end cap 42 includes an inwardly curved surface to define an inner wall of the vacuum-tight enclosure. A lip of the second hollow bore of each end cap 42 projects from the inner wall to define a first tubular projection 52 within the vacuum-tight enclosure. Each end cap 42 includes a secondary annular metallic element 48 retained between a wall of the respective second hollow bore of the end cap 42 and the respective portion of the rod 40. Each secondary annular metallic element 48 includes an outwardly projecting second circumferential portion 54 defining a shield between the corresponding end cap 42 and contact element 38.

In each embodiment employing the use of primary annular metallic elements 36, the use of primary annular metallic elements 36 results in a modular construction of the vacuum interrupter in which each primary annular metallic element 36 is used to interconnect different vacuum interrupter components which can have different shapes and sizes. The modular construction simplifies the design process for the vacuum interrupter because each vacuum interrupter component may be designed for fitment of a primary annular metallic element 36 instead of being designed to accommodate different types of connectors for connection to different components. It is therefore straightforward to add and remove components to the design of the vacuum interrupter when accounting for different operating environments which require different voltage ratings and/or have adverse weather conditions.

The design based on the use of primary annular metallic elements 36 allows for the self-alignment of components during construction of the vacuum interrupter and thereby simplifies the task of assembling heavy vacuum interrupter components. Each vacuum interrupter component may, for example, include features such as grooves 44 for fitment of the primary annular metallic element 36. These grooves 44 and the corresponding primary annular metallic element 36 can be used to properly position a vacuum interrupter component on top of another before the vacuum interrupter is placed inside a vacuum furnace or connected to a vacuum pumping and bake-out system for sealing off.

In other embodiments of the invention two primary annular metallic elements 36 may be connected in the form of a brazed joint that interconnects different vacuum interrupter components. In such a brazed joint, each primary annular metallic element 36 may be machined to closely fit the other primary annular metallic element 36 and any gap between the primary annular metallic elements 36 may be filled with brazing material. Such connection of primary annular metallic elements 36 provides the vacuum interrupter components with self-aligning capacity.

It is envisaged that in other embodiments of the invention, the braze joint may be replaced by a welded joint.

The use of primary annular metallic elements 36 therefore leads to an increase in accuracy and efficiency of the manufacture and assembly of the vacuum interrupter.

The various shapes of the end caps 42 in FIGS. 2 to 5 are designed to provide the necessary electrical insulation for the vacuum interrupter by adjusting electrostatic field distribution to reduce inter-component voltage stress. The modular construction of the vacuum interrupter allows the use of end caps 42 with different sizes and shapes to provide the necessary electrical insulation for the vacuum interrupter. This reduces the complexity of the design and manufacturing process because it is only necessary to account for the shape of the end cap 42 when trying to achieve a specific level of electrical insulation.

The modular construction of the vacuum interrupter also makes it straightforward to use different end caps 42 with different numbers of second hollow bores to allow the use of one or more standard rods or one or more other rods 40,40*a*.

Preferably each end cap 42 has a composition including glass or including glass-ceramic. Vacuum interrupter end caps 42 having glass-based and/or glass-ceramic-based compositions provide excellent electrical insulation and are highly resistant to corrosion which removes the need for external housing when the interrupter is used outdoors. Glass-based and glass-ceramic-based end caps 42 with various shapes and sizes are cheaper and require less energy to manufacture when compared to conventional metallised alumina ceramic housings and can be recycled easily by re-melting. The use of glass-based and/or glass-ceramic-based end caps 42 is therefore preferable in terms of economy and environmental concern.

The composition of the glass or glass-ceramic end cap 42 is preferably modified to absorb X-ray radiation emitted by vacuum interrupters during operation to minimise external radiation and thereby provide a safe working environment for those working in the vicinity of the vacuum interrupter.

It is envisaged that in embodiments of the invention the diameter of each end cap 42 may be larger than the diameter of the tubular bellows 30 to shield the tubular bellows 30 from adverse weather conditions or to protect the tubular bellows 30 from being damaged in the event that the vacuum interrupter is dropped during transport.

As shown in FIGS. 2 to 5, a shield between the contact elements 38 and the respective end cap 42 can be provided in the form of a flow-formed circumferential portion extending from the respective rod 40, a circumferential portion fitted around the rod 40 or a circumferential portion extending from a secondary annular metallic element 48. Each shield is desirable to maintain the dielectric strength of the respective end cap 42 during separation of the opposed contact surfaces so as to extend the lifetime of the vacuum interrupter. Otherwise, without a shield, the evaporation of metal from the opposed contact surfaces due to arc discharge will result in the deposition of a metal layer on the surface of each end cap 42 and thereby lead to a decrease in dielectric strength of the end caps 42. The shield may however be omitted from the vacuum interrupter to save costs depending on the required level of electrical insulation and on the level of metal deposition due to arc discharge.

Preferably each rod 40 is substantially cylindrical and the vacuum interrupter is axi-symmetric about the cylindrical axis of each rod 40. The provision of an axi-symmetric vacuum interrupter results in a homogenous distribution of electrical stress about the axis of the cylindrical rods 40 which simplifies the design process of electrical insulation for the vacuum interrupter. In addition, the homogenous distribution of electrical stress minimise the possibility of the development of regions with high electrical stress.

It is also preferable that the various vacuum interrupter components include curved surfaces and have a minimal amount of sharp edges because sharp edges in high voltage equipment typically leads to high electrical stress in the vicinity of the sharp edges. The use of glass-based or glass-ceramic-based end caps 42 is advantageous in this sense because it is straightforward and cheap to form glass-based structures which have the required shape.

The vacuum interrupter may also include a plurality of housing members 56, each housing member 56 being operably connected between the tubular bellows 30 and the respective sub-assembly 34 to define the vacuum-tight enclosure.

Figure 6:
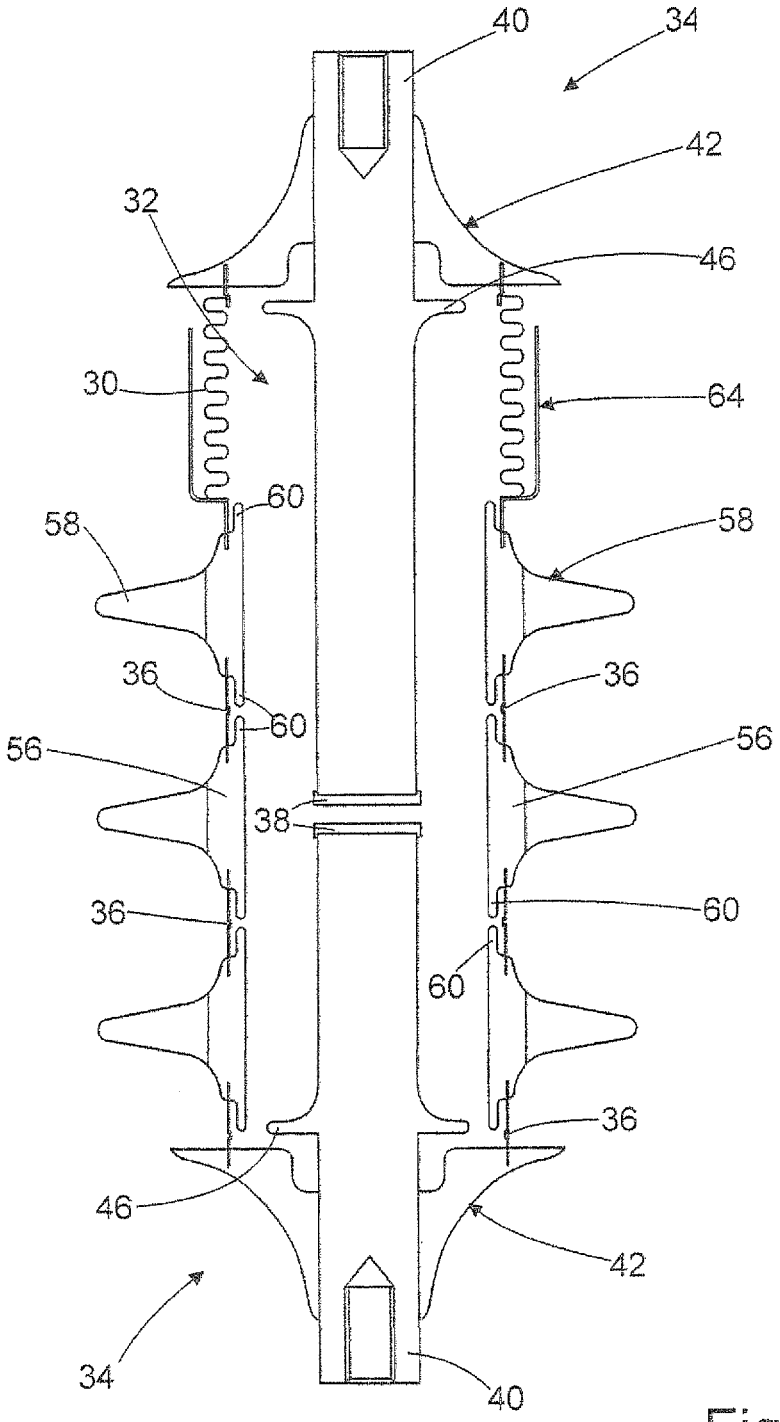
FIG. 6 shows a vacuum interrupter according to a fifth embodiment of the invention.

In FIG. 6, each housing member 56 is connected in series between a first end of the tubular bellows 30 and one of the respective end caps. The second end of the tubular bellows 30 is connected to the other end cap 42. Each housing member 56 is connected to an end cap 42, a neighbouring housing member 56 or one of the respective ends of the tubular bellows 30 via one or two primary annular metallic elements 36.

When two primary annular metallic elements 36 are used to interconnect vacuum interrupter components, each of the two primary annular metallic elements 36 may be machined to closely fit the other primary annular metallic element 36 so as to provide the vacuum interrupter components with self-aligning capacity. These primary annular metallic elements 36 may be brazed to each other to define a brazed joint. It is envisaged that these annular elements 36 may also be welded to each other to define a welded joint.

Each housing member 56 may include at least one groove 44 for retention of each corresponding primary annular metallic element 36.

Each housing member 56 defines first and second housing portions, the first housing portion defining a third hollow bore and being located within the enclosure and the second housing portion being located outside the enclosure. Each housing member 56 may include a shed 58 in the form of an outwardly projecting circumferential portion of the second housing portion, as shown in FIG. 6. These sheds 58 may be manufactured as part of the respective housing member 56 or be added onto the respective housing member 56 at a later stage. Each optional shed 58 increases the string distance of the vacuum interrupter and thereby provides additional electrical insulation to the vacuum interrupter without significantly changing the overall design of the vacuum interrupter.

Such sheds 58 may be manufactured from glass or glass-ceramic. The shed material may have a lower melting point than the glass and glass-ceramic material used in the corresponding housing members. However, the shed material is selected so that the sheds 58 have thermal properties, such as thermal expansion coefficient, that closely match those of the corresponding housing member 56. The provision of sheds 58 and housing members 56 having similar thermal properties minimises the problem of deteriorating interfacial layers that is typically associated with polymeric sheds attached to alumina ceramic housings.

A shed 58 may be added to a housing member 56 by heating a shed-less vacuum interrupter in an oven up to at least the melting point of the shed material and then pouring the shed material into a mould surrounding the respective housing member.

The lower melting point of the shed material compared to that of the housing member material means that the structure of the housing member 56 is unaffected by the heating process. Additionally, since the vacuum interrupter is sealed to form a vacuum-tight enclosure, the addition of a shed to a housing member 56 does not affect the internal structure of the vacuum interrupter. Subsequent cooling of the vacuum interrupter and removal of the mould results in the formation of a shed 58 on the circumference of the corresponding housing member 56. Such manufacture of sheds 58 is made possible by the use of glass and/or glass-ceramic materials which are straightforward and cheap to process.

The shed formation step may be omitted during the initial manufacturing stage of the vacuum interrupter and sheds may be added to the vacuum interrupter at a later stage, if desired. Such an ability leads to a reduction in costs because it is possible to design a single manufacturing process for vacuum interrupters with and without sheds since the optional shed formation step may be added after the manufacture of the vacuum interrupter.

The omission of shed formation from the initial manufacturing stage of the vacuum interrupter also means that it is possible to accommodate a higher number of vacuum interrupters inside a furnace during the brazing stage. This is because additional vacuum interrupters can occupy space inside the furnace that would otherwise have been occupied by sheds 58 attached to the other vacuum interrupters.

In addition, simultaneous brazing of a high number of vacuum interrupters in sequence increases the efficiency of the vacuum interrupter manufacturing process.

The provision of the plurality of housing members 56 permits the extension of the vacuum interrupter length and thereby increases the potential amount of separation and, therefore, the insulation between the opposed contact surfaces. This leads to an increase in voltage rating and performance of the vacuum interrupter.

The use of housing members 56 is also compatible with the modular construction of the vacuum interrupter since it is possible to design the housing members 56 to have a standard shape and size and to be stackable on top of each other to extend the vacuum interrupter length. The use of standard housing members 56 leads to a reduction in manufacturing cost because there is no need to account for housing members 56 of different lengths when designing the manufacturing process.

The modular nature of the vacuum interrupter is advantageous in that the increased height of the vacuum interrupter typically leads to an increase in instability which can be avoided by using primary annular metallic elements 36 to achieve self-aligning stacking of the housing members 56. The modular nature of the vacuum interrupter also allows interchanging of the positions of the housing members 56 and tubular bellows 30 depending on installation requirements.

In FIG. 6, a lip of each third hollow bore projects from both ends of the respective first housing portion to define a second tubular projection 60 at the respective end within the vacuum-tight enclosure. In other embodiments (not shown), a lip of each third hollow bore projects from only one end of the respective first housing portion to define a second tubular projection 60 at the respective end within the vacuum-tight enclosure. The or each second tubular projection 60 can be used to provide a shield so that any metal deposition due to arc discharge is limited to the inner walls of each second tubular projection 60 and each third hollow bore. Consequently the shielded surfaces remain clear of metal deposits and thereby maintain their respective dielectric strength.

Figure 7:
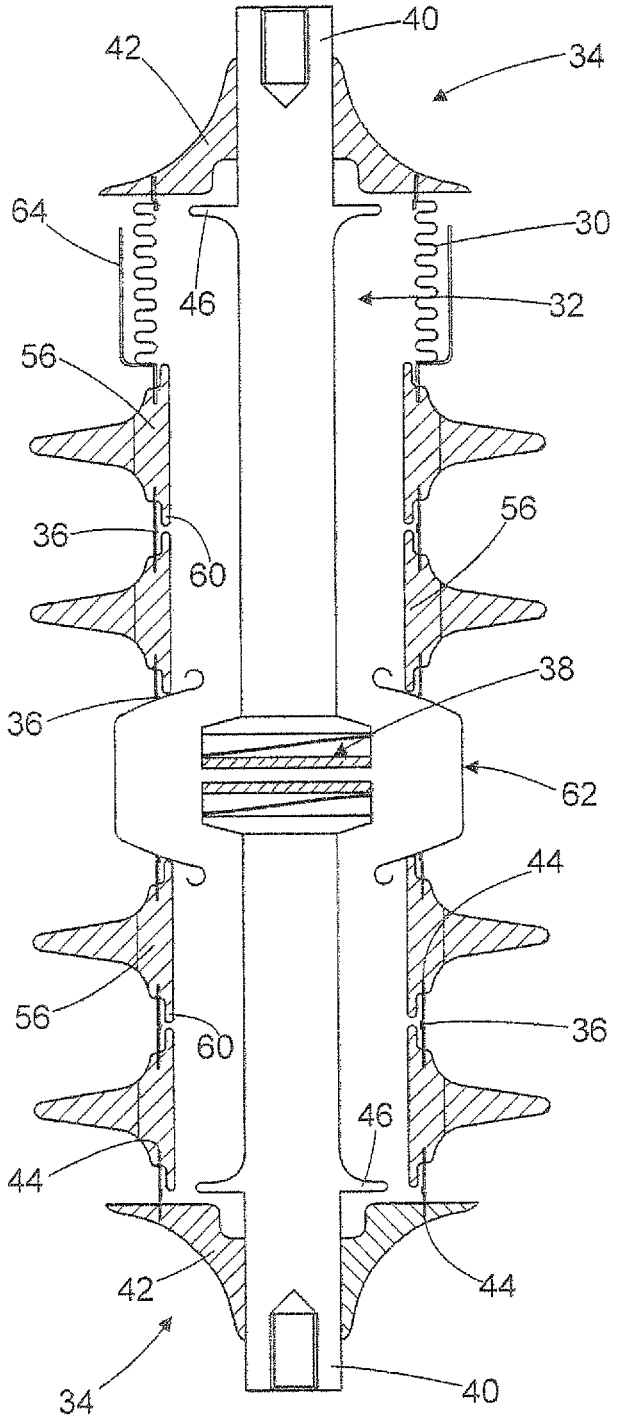
FIG. 7 shows a vacuum interrupter according to a sixth embodiment of the invention.

One of the housing members 56 may include a metallic composition to define an arc containment chamber 62, as shown in FIG. 7, whereby the contact 38 elements are located within the arc containment chamber 62. The purpose of the arc containment chamber 62 is to limit the effects of the vacuum discharge to the arc containment chamber 62 due to arc instability, maintain the dielectric strength of the vacuum interrupter components by limiting the effects of metal vapour deposition and ensure the parallelism of electrostatic field lines within the vacuum interrupter.

Figure 8:
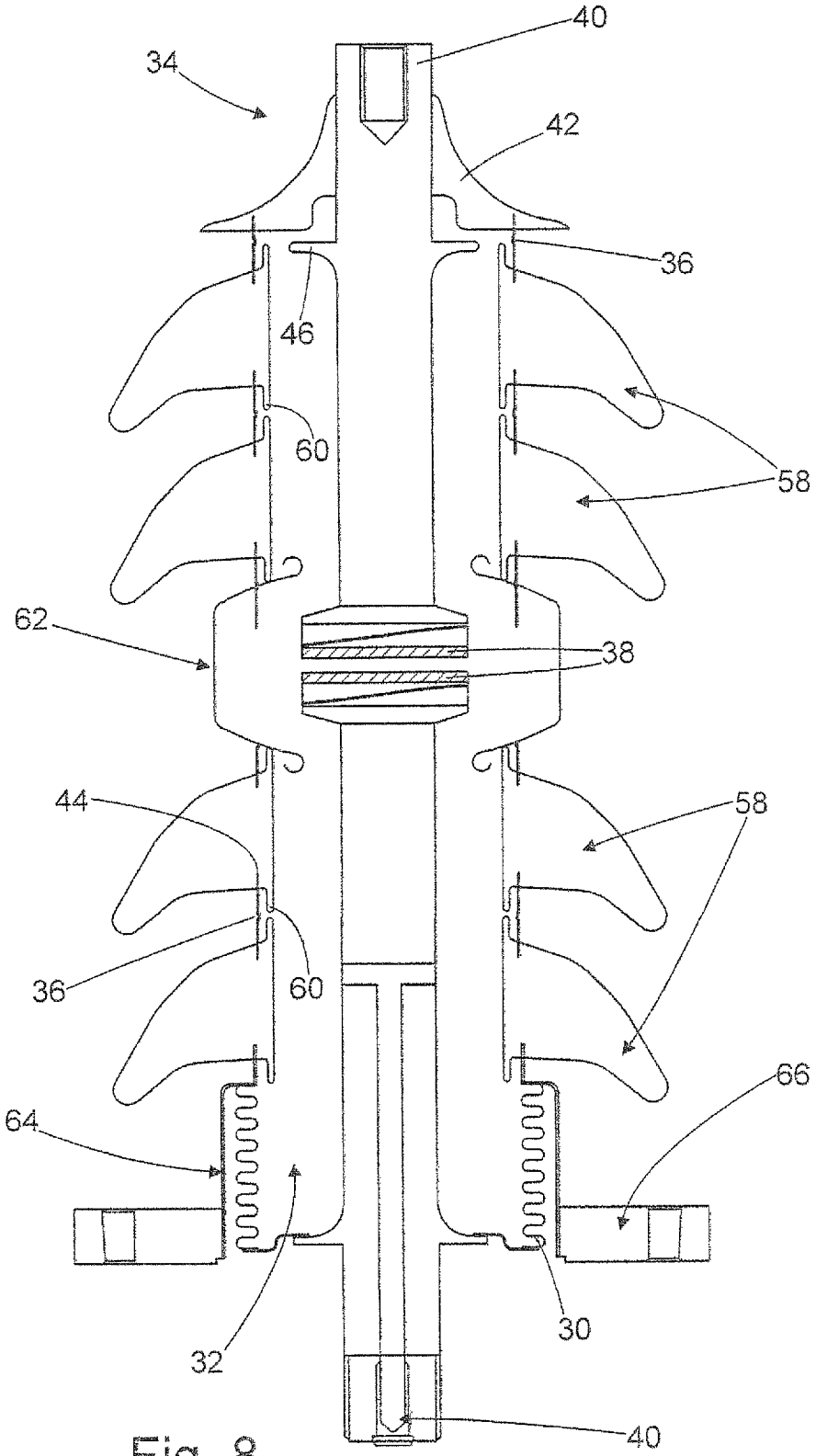
FIG. 8 shows a vacuum interrupter according to a seventh embodiment of the invention.

A further embodiment of a vacuum interrupter based on the use of one sub-assembly 34 instead of two sub-assemblies 34 is shown in FIG. 8. In the further embodiment, the tubular bellows 30 is connected to an end cap 42, in the form of a truncated cone, via a series of housing members 56 at a first end and is operably connected to a rod 40 via an annular connector at a second end to define the vacuum-tight enclosure.

FIG. 8 also shows an alternative shape for each shed 58 of the respective housing member 56. Each shed 58 is shaped to curve downwards such that each shed 58 acts as an overhanging roof to protect the vacuum interrupter from adverse weather conditions such as rain or snow.

An external shield 64 may be provided around the outer walls of the tubular bellows 30, as shown in FIGS. 6 to 8. The external shield 64 may include an outwardly projecting circumferential portion, which may be in the form of a flange as seen in FIG. 8. The circumferential portion of the external shield 64 is used to provide mechanical stability to the interrupter during its operation when mounted onto a platform. The external shield can also be used to mount the vacuum interrupter onto a platform or be used to limit the travel distance of the tubular bellows 30 so as to provide improved control over the operation of the vacuum interrupter. In addition, the provision of an external shield 64 protects the tubular bellows 30 from damage due to adverse weather conditions.

The invention claimed is:

1. A vacuum interrupter comprising:

a tubular bellows including a first hollow bore;

at least one sub-assembly, the each sub-assembly including an end cap, the each end cap including at least one second hollow bore and having a composition including glass or including glass-ceramic;

at least one primary annular metallic element being operably connected between the each end cap and one of respective ends of the tubular bellows;

a pair of electrically conductive contact elements; and a pair of electrically conductive rods, each rod being operably connected to a respective contact element at a first end and being connected in use to an electrical network at a second end, a portion of at least one rod being retained inside the or each second hollow bore of a respective end cap, wherein the each end cap and each rod are operably connected to one of the respective ends of the tubular bellows to define a vacuum-tight enclosure;

the contact elements are located inside the enclosure and arranged to define opposed contact surfaces; and the tubular bellows is controllable to expand or contract to move one rod relative to the other rod to open or close a gap between the opposed contact surfaces.

2. A vacuum interrupter according to claim 1 wherein the or each end cap includes a groove for retention of a primary annular metallic element.

3. A vacuum interrupter according to claim 1 wherein an outer wall of the or each end cap is tapered to define a truncated cone, the base of the or each truncated cone being connected to a primary annular metallic element.

4. A vacuum interrupter according to claim 1 wherein the or each end cap is substantially cylindrical and includes an outwardly projecting first circumferential portion.

5. A vacuum interrupter according to claim 4 wherein the first circumferential portion is in the form of a flange.

6. A vacuum interrupter according to claim 1 wherein the or each end cap includes an inwardly curved surface to define an inner wall of the vacuum-tight enclosure.

7. A vacuum interrupter according to claim 6 wherein a lip of the or each second hollow bore projects from the inner wall to define a first tubular projection within the vacuum-tight enclosure.

8. A vacuum interrupter according to any of the preceding claims 1-7 wherein the or each end cap includes two or more second hollow bores.

9. A vacuum interrupter according to any of the preceding claims 1-7 wherein each rod is made from copper.

10. A vacuum interrupter according to any of the preceding claims 1-7 wherein the or each end cap is bonded using brazed joints to the portion of the or each rod retained inside its respective second hollow bore.

11. A vacuum interrupter according to any of claims 1 to 7 wherein the or each sub-assembly further includes at least one secondary annular metallic element retained between a wall of the respective second hollow bore of the end cap and the respective portion of the rod.

12. A vacuum interrupter according to claim 11 wherein the or each secondary annular metallic element includes an outwardly projecting second circumferential portion defining a shield between the corresponding end cap and contact element.

13. A vacuum interrupter according to any of claims 1-7 wherein each rod includes an outwardly projecting third circumferential portion defining a shield between the corresponding end cap and contact element.

14. A vacuum interrupter according to claim 12 wherein the or each circumferential portion is in the form of a flange.

15. A vacuum interrupter according to any of claims 1-7 further including one or more housing members, the or each housing member being operably connected between the tubular bellows and the respective sub-assembly to define the vacuum-tight enclosure wherein the or each housing member defines first and second housing portions, the first housing portion defining a third hollow bore and being located within the enclosure and the second housing portion being located outside the enclosure.

16. A vacuum interrupter according to claim 15 wherein the or each housing member is connected to an end cap, a neighbouring housing member or one of the respective ends of the tubular bellows via at least one primary annular metallic element.

17. A vacuum interrupter according to claim 15 wherein two primary annular metallic elements are connected to one another to form a brazed or welded joint to connect the or each housing member to an end cap, a neighbouring housing member or one of the respective ends of the tubular bellows.

18. A vacuum interrupter according to claim 16 wherein the or each housing member includes at least one groove for retention of each corresponding primary annular metallic element.

19. A vacuum interrupter according to claim 15 wherein a lip of at least the third hollow bore projects from an end or both ends of the respective first housing portion to define a second tubular projection at the respective end within the vacuum-tight enclosure.

20. A vacuum interrupter according to claim 15 wherein the or each housing member further includes a shed in the form of an outwardly projecting fourth circumferential portion.

21. A vacuum interrupter according to claim 15 wherein the or at least one housing member is formed from a glass or glass-ceramic material.

22. A vacuum interrupter according to claim 20 wherein the or each housing member is formed from a glass or glass-ceramic material and the or each shed is formed from a glass or glass-ceramic material having a lower melting point than the glass or glass-ceramic material used in the corresponding housing member.

23. A vacuum interrupter according to claim 15 wherein the or at least one housing member has a metallic composition to define an arc containment chamber and the contact elements are located within the third hollow bore of the arc containment chamber.

24. A vacuum interrupter according to claim 15 further including an external shield provided around the tubular bellows.

25. A vacuum interrupter according to claim 24 wherein the external shield includes an outwardly projecting fifth circumferential portion.

26. A vacuum interrupter according to claim 15 wherein each rod is substantially cylindrical and the vacuum interrupter is axi-symmetric about the cylindrical axis of at least one of the rods.

27. A vacuum interrupter according to claim 8 wherein each rod is made from copper.

28. A vacuum interrupter according to claim 27 wherein the or each end cap is bonded using brazed joints to the portion of the or each rod retained inside its respective second hollow bore.

29. A vacuum interrupter according to claim 27 wherein the or each sub-assembly further includes at least one secondary annular metallic element retained between a wall of the respective second hollow bore of the end cap and the respective portion of the rod.

30. A vacuum interrupter according to claim 28 wherein the or each sub-assembly further includes at least one secondary annular metallic element retained between a wall of the respective second hollow bore of the end cap and the respective portion of the rod.

31. A vacuum interrupter according to claim 8 wherein each rod includes an outwardly projecting third circumferential portion defining a shield between the corresponding end cap and contact element.

32. A vacuum interrupter according to claim 9 wherein each rod includes an outwardly projecting third circumferential portion defining a shield between the corresponding end cap and contact element.

33. A vacuum interrupter according to claim 10 wherein each rod includes an outwardly projecting third circumferential portion defining a shield between the corresponding end cap and contact element.

34. A vacuum interrupter according to claim 11 wherein each rod includes an outwardly projecting third circumferential portion defining a shield between the corresponding end cap and contact element.

35. A vacuum interrupter according to claim 13 wherein the or each circumferential portion is in the form of a flange.

36. A vacuum interrupter according to claim 8 further including one or more housing members, the or each housing member being operably connected between the tubular bellows and the respective sub-assembly to define the vacuum-tight enclosure wherein the or each housing member defines first and second housing portions, the first housing portion defining a third hollow bore and being located within the enclosure and the second housing portion being located outside the enclosure.

37. A vacuum interrupter according to claim 9 further including one or more housing members, the or each housing member being operably connected between the tubular bellows and the respective sub-assembly to define the vacuum-tight enclosure wherein the or each housing member defines first and second housing portions, the first housing portion defining a third hollow bore and being located within the enclosure and the second housing portion being located outside the enclosure.

38. A vacuum interrupter according to claim 10 further including one or more housing members, the or each housing member being operably connected between the tubular bellows and the respective sub-assembly to define the vacuum-tight enclosure wherein the or each housing member defines first and second housing portions, the first housing portion defining a third hollow bore and being located within the enclosure and the second housing portion being located outside the enclosure.

39. A vacuum interrupter according to claim 11 further including one or more housing members, the or each housing member being operably connected between the tubular bellows and the respective sub-assembly to define the vacuum-tight enclosure wherein the or each housing member defines first and second housing portions, the first housing portion defining a third hollow bore and being located within the enclosure and the second housing portion being located outside the enclosure.

40. A vacuum interrupter according to claim 12 further including one or more housing members, the or each housing member being operably connected between the tubular bellows and the respective sub-assembly to define the vacuum-tight enclosure wherein the or each housing member defines first and second housing portions, the first housing portion defining a third hollow bore and being located within the enclosure and the second housing portion being located outside the enclosure.

41. A vacuum interrupter according to claim 17 wherein the or each housing member includes at least one groove for retention of each corresponding primary annular metallic element.

42. A vacuum interrupter according to claim 16 wherein a lip of the or each third hollow bore projects from an end or both ends of the respective first housing portion to define a second tubular projection at the respective end within the vacuum-tight enclosure.

43. A vacuum interrupter according to claim 17 wherein a lip of the or each third hollow bore projects from an end or both ends of the respective first housing portion to define a second tubular projection at the respective end within the vacuum-tight enclosure.

44. A vacuum interrupter according to claim 18 wherein a lip of the or each third hollow bore projects from an end or both ends of the respective first housing portion to define a second tubular projection at the respective end within the vacuum-tight enclosure.

45. A vacuum interrupter according to claim 16 wherein the or each housing member further includes a shed in the form of an outwardly projecting fourth circumferential portion.

46. A vacuum interrupter according to claim 17 wherein the or each housing member further includes a shed in the form of an outwardly projecting fourth circumferential portion.

47. A vacuum interrupter according to claim 18 wherein the or each housing member further includes a shed in the form of an outwardly projecting fourth circumferential portion.

48. A vacuum interrupter according to claim 19 wherein the or each housing member further includes a shed in the form of an outwardly projecting fourth circumferential portion.

49. A vacuum interrupter according to claim 16 wherein the or at least one housing member is formed from a glass or glass-ceramic material.

50. A vacuum interrupter according to claim 17 wherein the or at least one housing member is formed from a glass or glass-ceramic material.

51. A vacuum interrupter according to claim 18 wherein the or at least one housing member is formed from a glass or glass-ceramic material.

52. A vacuum interrupter according to claim 19 wherein the or at least one housing member is formed from a glass or glass-ceramic material.

53. A vacuum interrupter according to claim 20 wherein the or at least one housing member is formed from a glass or glass-ceramic material.

54. A vacuum interrupter according to claim 16 wherein the or at least one housing member has a metallic composition to define an arc containment chamber and the contact elements are located within the third hollow bore of the arc containment chamber.

55. A vacuum interrupter according to claim 17 wherein the or at least one housing member has a metallic composition to define an arc containment chamber and the contact elements are located within the third hollow bore of the arc containment chamber.

56. A vacuum interrupter according to claim 18 wherein the or at least one housing member has a metallic composition to define an arc containment chamber and the contact elements are located within the third hollow bore of the arc containment chamber.

57. A vacuum interrupter according to claim 19 wherein the or at least one housing member has a metallic composition to define an arc containment chamber and the contact elements are located within the third hollow bore of the arc containment chamber.

58. A vacuum interrupter according to claim 20 wherein the or at least one housing member has a metallic composition to define an arc containment chamber and the contact elements are located within the third hollow bore of the arc containment chamber.

59. A vacuum interrupter according to claim 21 wherein the or at least one housing member has a metallic composition to define an arc containment chamber and the contact elements are located within the third hollow bore of the arc containment chamber.

60. A vacuum interrupter according to claim 22 wherein the or at least one housing member has a metallic composition to define an arc containment chamber and the contact elements are located within the third hollow bore of the arc containment chamber.

61. A vacuum interrupter according to claim 19 further including an external shield provided around the tubular bellows.

* * * * *